US006070377A

United States Patent [19]

Guevara Gúzman

[11] Patent Number: 6,070,377

[45] Date of Patent: Jun. 6, 2000

[54] SELF SUPPORTING WALL PANELS FOR INTERIOR SPACES REQUIRING STERILIZATION, IMPERMEABILITY, AND THERMAL CHARACTERISTICS

[76] Inventor: Guillermo Guevara Gúzman, Apoquindo 6275, Of. 82, Las Condes, Santiago, Chile

[21] Appl. No.: 08/957,465

[22] Filed: Oct. 24, 1997

[30] Foreign Application Priority Data

Oct. 24, 1996 [CL] Chile ..... 1849-96

[51] Int. Cl.[7] ..... E04H 1/00

[52] U.S. Cl. ..... 52/238.1; 52/582.1

[58] Field of Search ..... 52/238.1, 578, 52/582.1, 590.1, 590.2

[56] References Cited

U.S. PATENT DOCUMENTS 4,733,512 3/1988 Kiselewski ..... 52/238.1
5,377,467 1/1995 Barnavol ..... 52/238.1

*Primary Examiner*—Beth A. Aubrey

*Attorney, Agent, or Firm*—Finnegan, Henderson, Farabow, Garrett & Dunner, L.L.P.

[57] ABSTRACT

Self supporting panels with sterilization, impermeabilization and thermal characteristics, quickly assembled and fixed, with higher structural resistance; useful to form different areas that need to be heat and sanitary isolated, including stores and laboratories, hospitals and other sterilized places. Their external surfaces are perfectly smooth, sterilized and wash resistant. They have a dovetail assembly system and superior-inferior concave round edges which can be easily cleaned, forming perfectly hermetic walls, removing edging borders and filtrations between ceiling, panels and floor. They have a simple and safe system to fix ceiling panels and floor. Additionally, they are fixed to different intersection parts, forming concave round edging corner, avoiding edging borders between walls and obtaining different wall distribution combinations. In some panels, it can be included general installations; in others, door closings and thermal windows close to smooth panel surfaces; and in others, superior and inferior concave projecting edges can be laterally extended in order to be joined to existing walls.

11 Claims, 12 Drawing Sheets

SELF SUPPORTING WALL PANELS FOR INTERIOR SPACES REQUIRING STERILIZATION, IMPERMEABILITY, AND THERMAL CHARACTERISTICS

BACKGROUND OF THE INVENTION

Currently, interior walls of isolated places such as warehouses, cold storage rooms, stores, laboratory, hospital, clinic and surgery rooms, places for food production, etc., which require temperature conditioning, and at the same time, require sterilization conditions, present cleaning inconvenience, lack of hygiene, impermeability problems, and difficulties with closures.

On the one hand, there are different types of panels available in the market for forming isolated places that can be temperature conditioned. On the other hand, those places which require sterile conditions are only formed by interior walls of existing buildings. At present, there are no panels which can satisfy the cleaning, hygienic and impermeability requirements for such thermally protected and sterilized places.

According to general rules applied to sterilized places, interior walls must be cleaned easily, and walls of critical areas must be perfectly smooth, washable and capable of being sterilized. Therefore, they must be free of projections and discontinuities. Also, edging joints existing between walls, between walls and ceiling, and between walls and floor, should be eliminated. Closings must be watertight and should be built with isolating glass panes. It is desirable to keep sterilized areas perfectly hermetic and to avoid recesses and projections.

Traditional heat-insulating panels are formed by rectangular bodies consisting of two exterior sheets generally made of steel—although this material often causes oxidation problems due to damages and strikes—and by a nucleus filled with insulating material, such as expanded polystyrene, rigid polyurethane, etc. The exterior surfaces often have ribs, box pleatings, fluted cracks, etc., which are caused by some structural strength requirements, producing hygienic problems and making cleaning activities difficult because of the presence of areas that allow both dust deposits and other kinds of volatile substance accumulation. Also, panels offer an assembly solution, which does not allow completely hermetic joints between panels. However, the main difficulty with these elements is a hygienic problem, because they allow for bacteria and microorganism accumulation, they cause filtration problems, in addition to the non-solution of the edge joining problems.

Interior walls of sterilized areas require the use of expensive coatings, wall interventions and other extra installations to guarantee the best impermeability against polluting agents, the avoidance of thermal oscillations, the highest natural light conditions and the correct attraction of solar energy. Nevertheless, it can happen that the type of covering used sometimes is not the most desirable, for example, the typical use of glazed tile, which, from a hygienic point of view, offers certain deficiencies because of the presence of microbiologic implantations and difficulty in cleaning joints existing between glazed tiles.

SUMMARY OF THE INVENTION

The current invention offers self supporting panels with sterilization, thermal and impermeability characteristics, a high structural strength and the ability to be assembled and fixed quickly. So they are useful to form different areas that need to be heat and sanitary isolated, specially places such as stores and laboratories, hospitals, places for food production line and other sterilized places. Their external surfaces are perfectly smooth; they can be washed and sterilized easily. They are made of glass fiber, reducing the danger of oxidation problems and obtaining higher resistance to chemical agents that cause several damages due to continuous washes. Their core is made of polyurethane, allowing a correct heat-isolation. They have a lateral dovetail joint system and top and bottom round concave edges, which can be cleaned easily, so panels allow for perfectly hermetic walls, eliminating edging borders, filtrations and hygienic problems between ceiling, panel and floor. They have a simple and safe system to fix ceiling and floor panels. Additionally, they are joined to different intersection points forming round concave edging corners, so that edging borders between walls can be avoided and different wall distribution combinations can be obtained. In some panels, general electrical, water, oxygen, gas, and compressed air installations, etc. can be incorporated. In others, it is possible to introduce thermal door and window closings near to smooth panel surfaces. And in still others, projecting concave bottom and top edges can be laterally extended in order to join top panels with existing walls.

BRIEF DESCRIPTION OF THE DRAWINGS

The preferred embodiment of the invention will be described with reference to the accompanying non-restrictive drawing illustrations, in which.

DETAILED DESCRIPTION OF THE PREFERRED EMBODIMENTS

Figure 1:
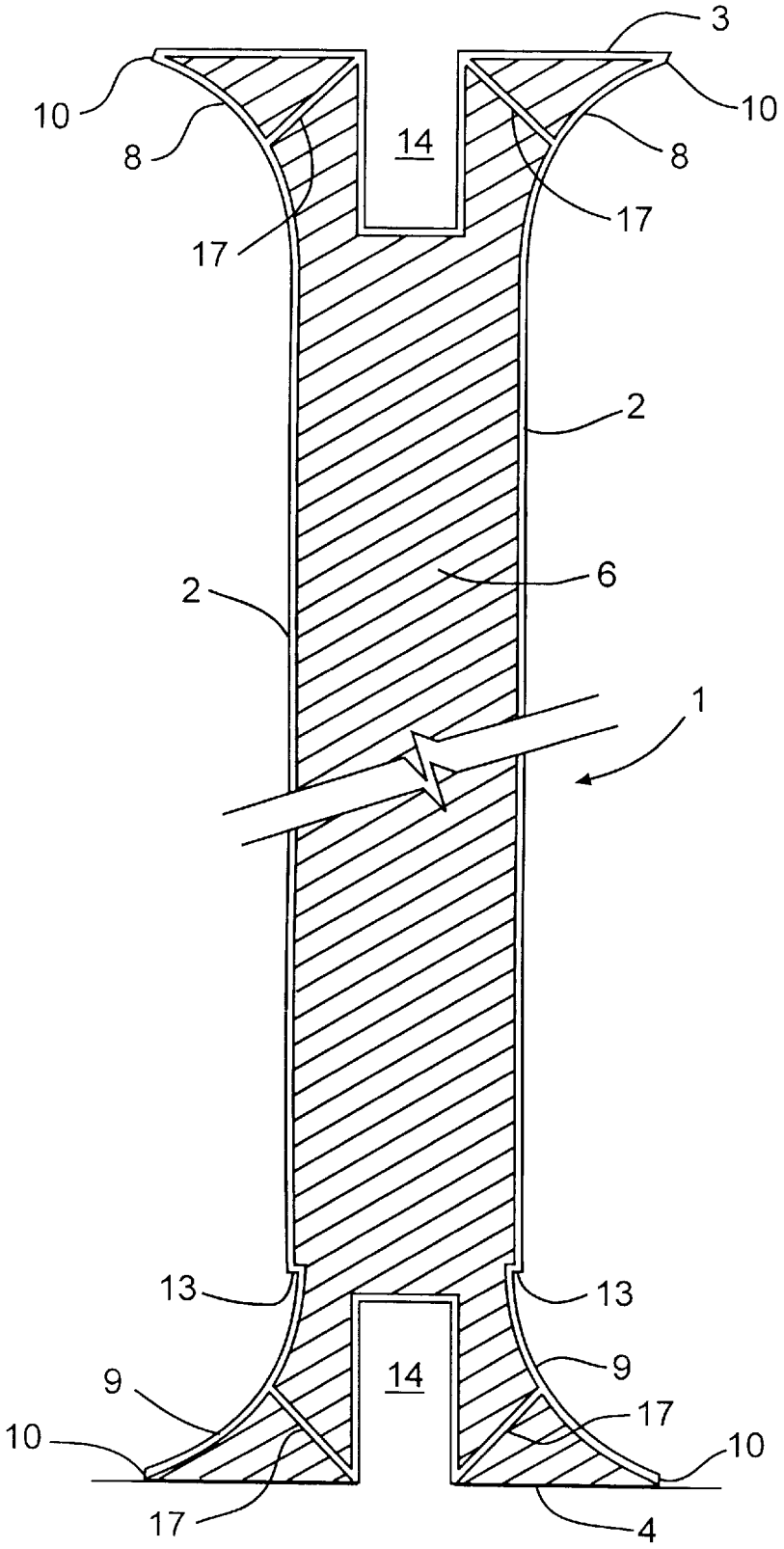
FIG. 1 is a vertical cross-section of a panel of the invention.
Figure 2:
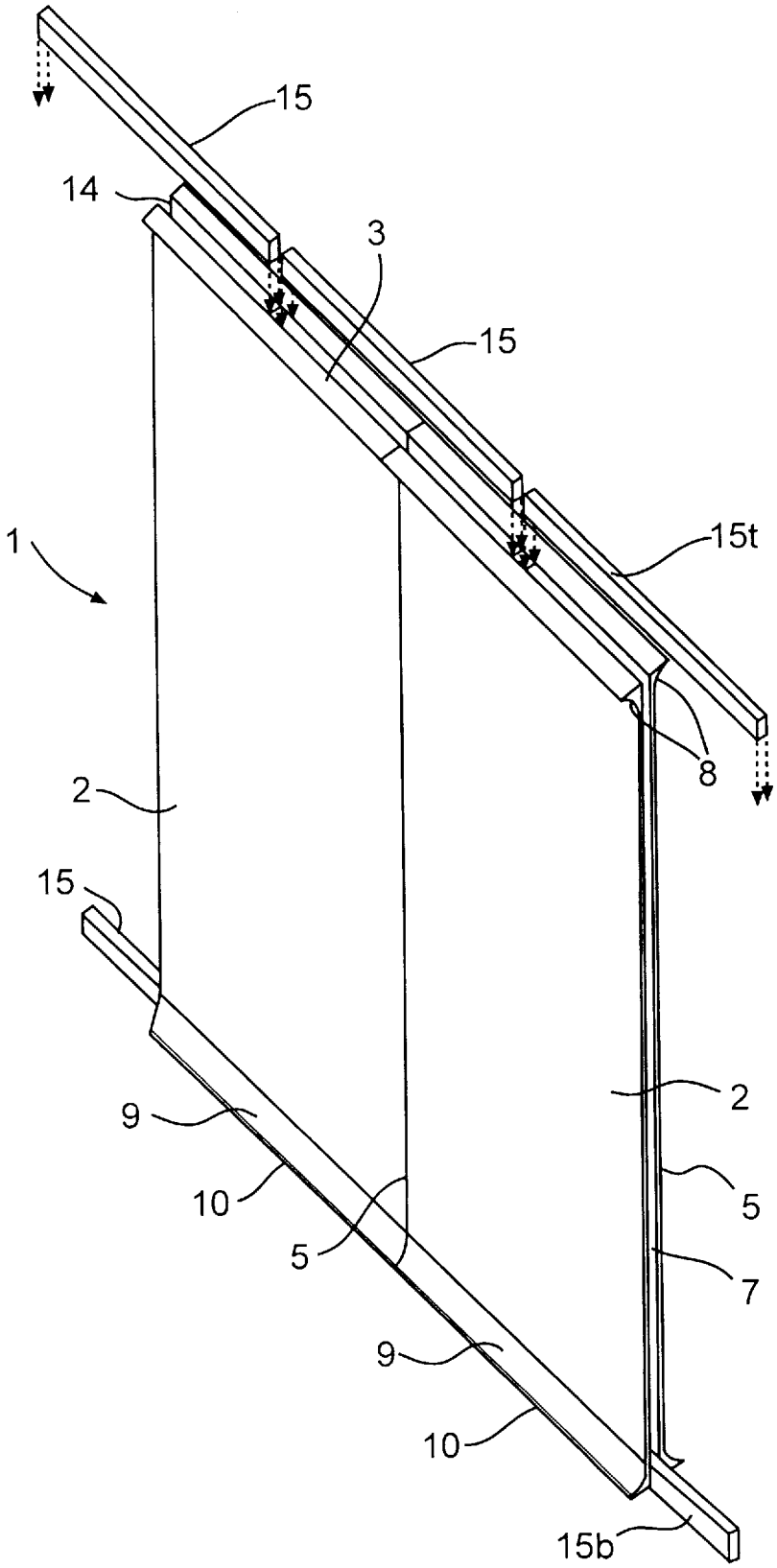
FIG. 2 is a perspective view of two such panels assembled with top and bottom tracks.
Figure 3:
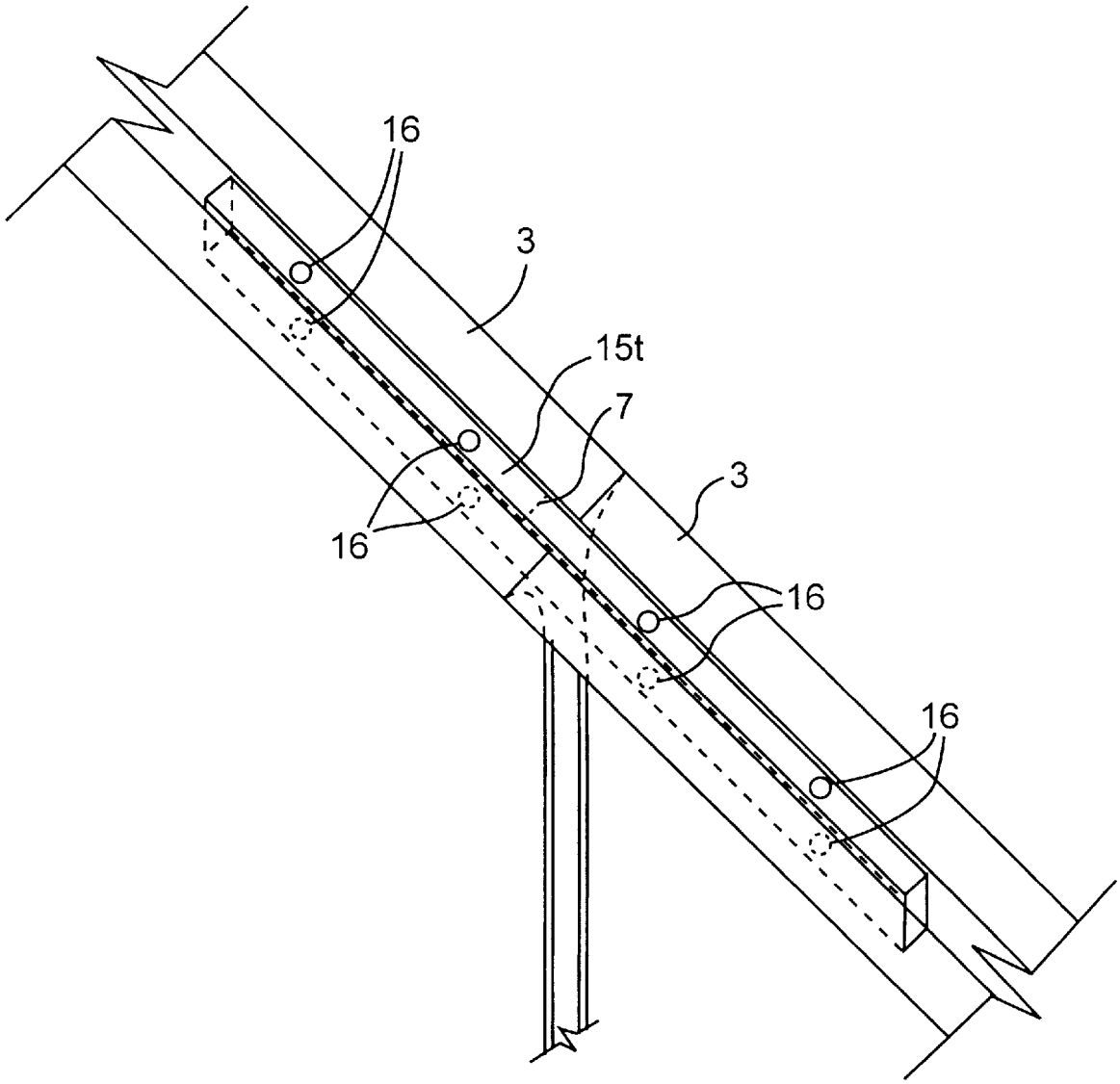
FIG. 3 is a perspective view of two assembled panels joined to a top track.
Figure 4:
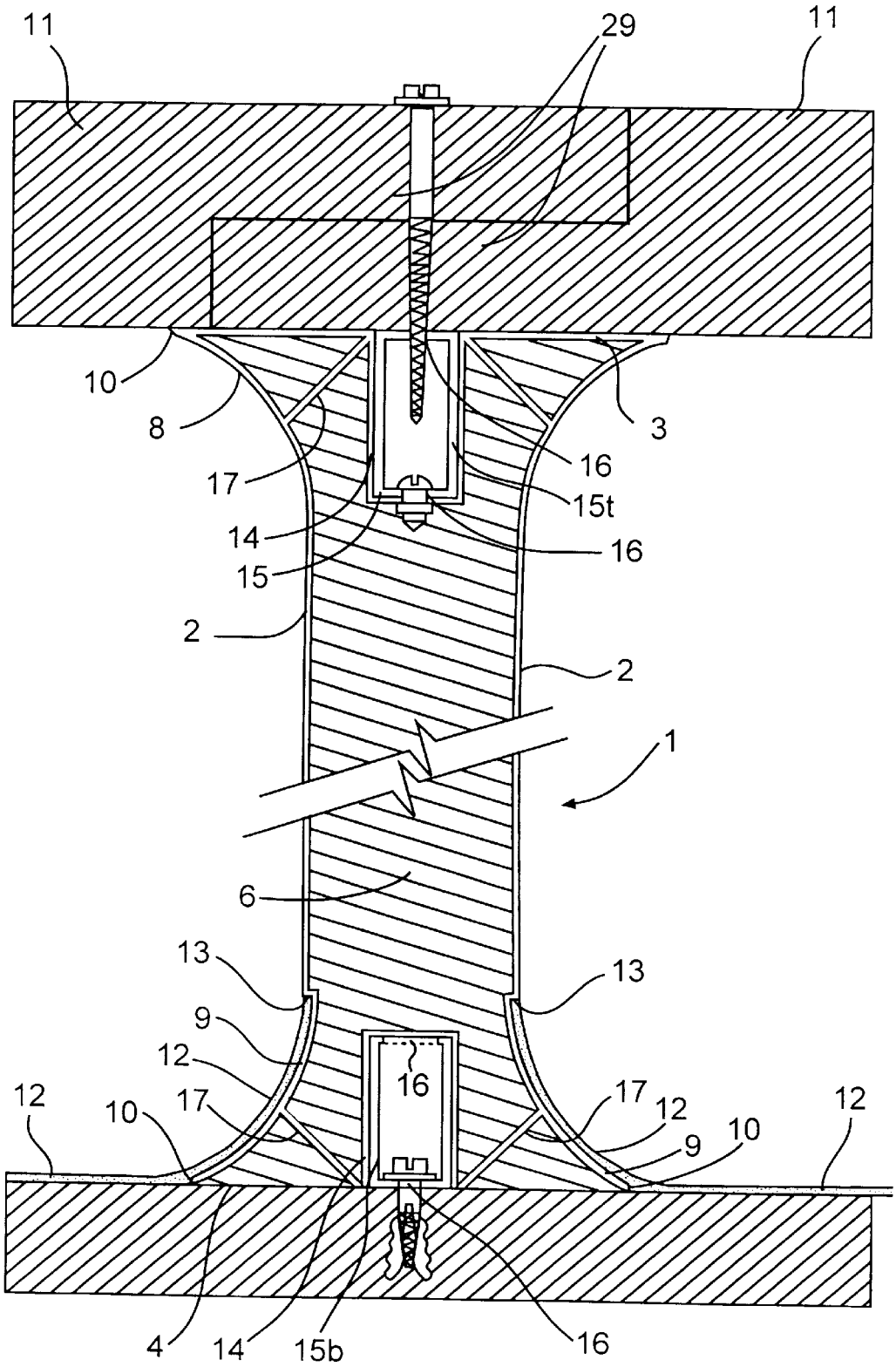
FIG. 4 is a vertical cross-section of a panel joined to top and bottom tracks, to a ceiling panel, and to the floor.
Figure 5:
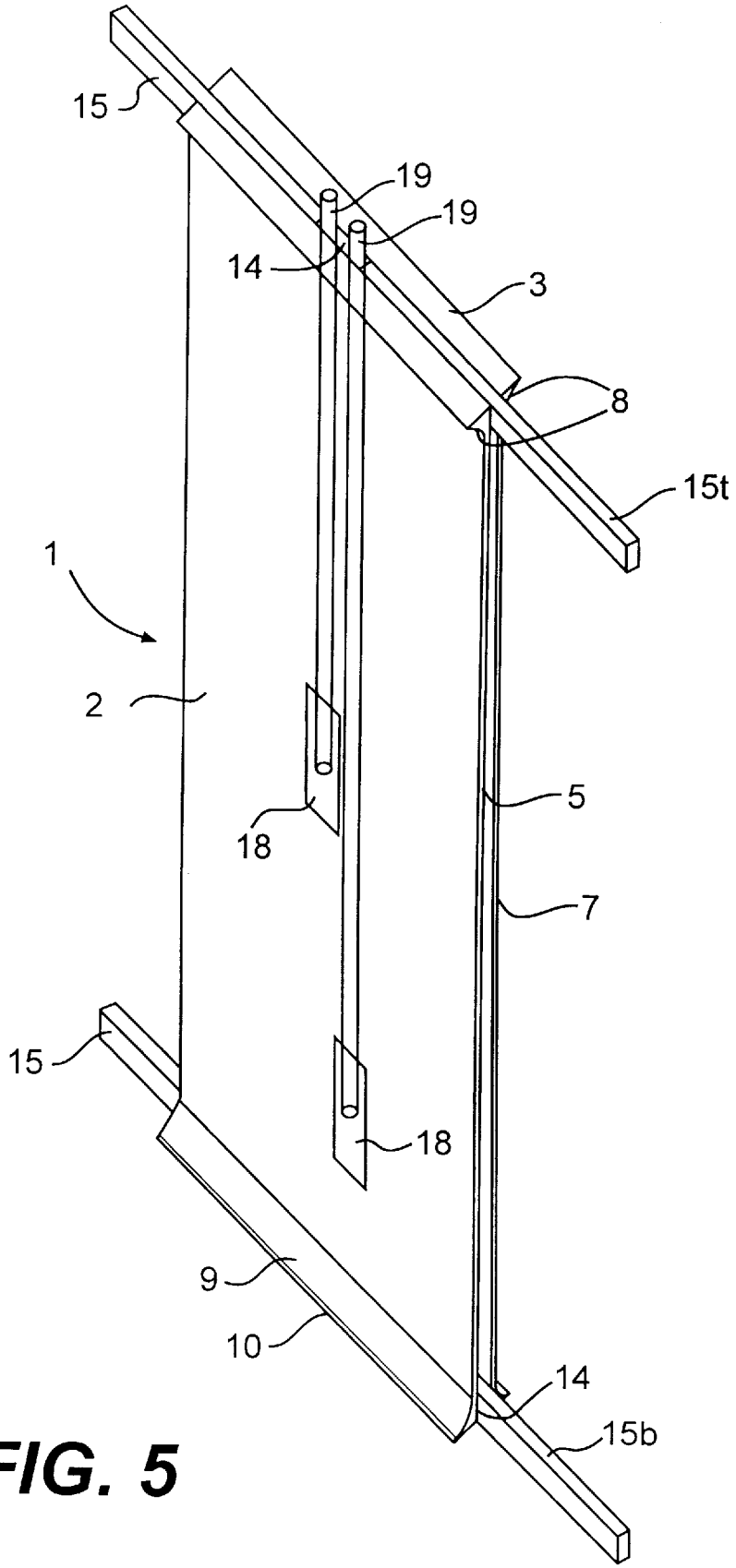
FIG. 5 is a perspective view of a panel with electrical installations and top and bottom tracks.
Figure 6A:
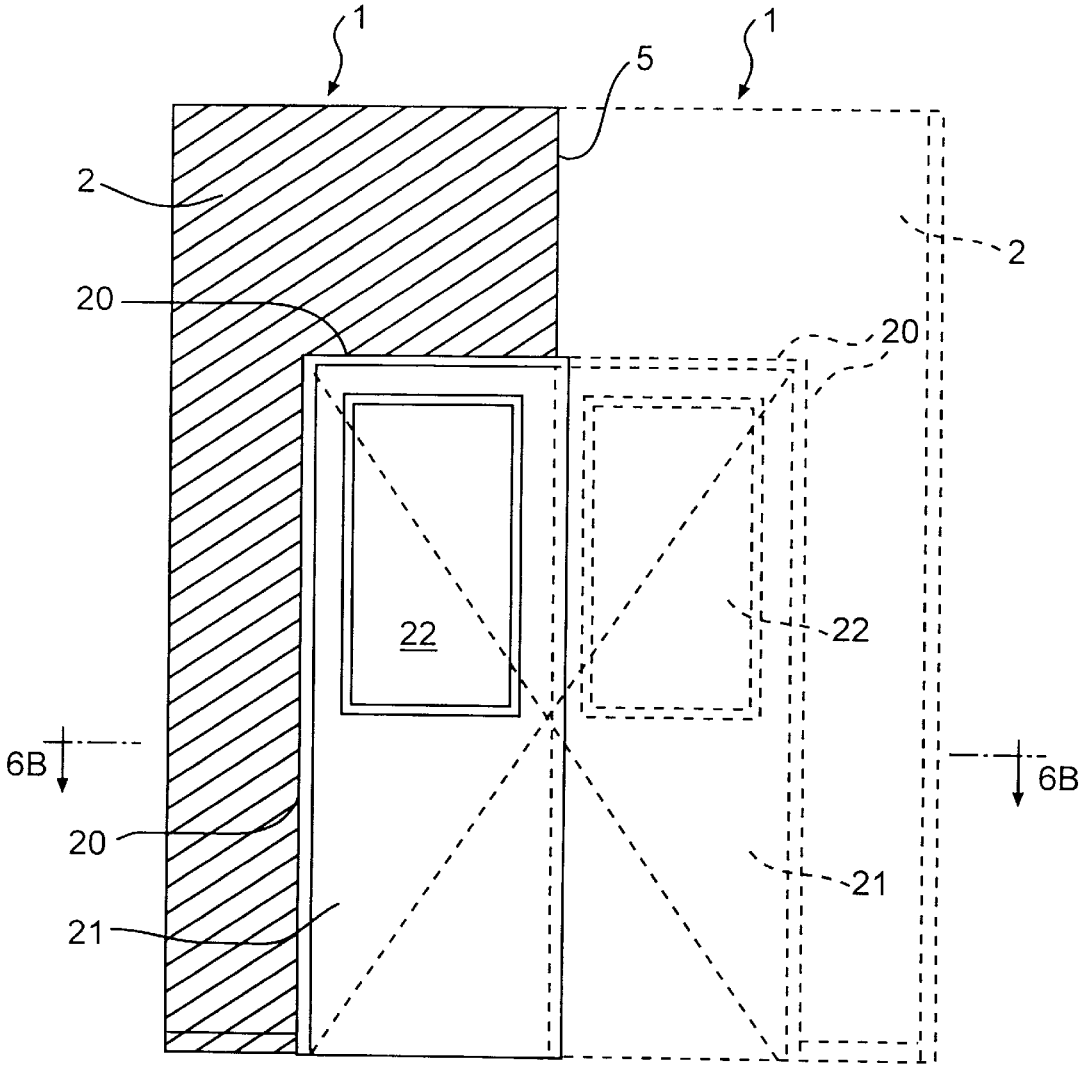
FIG. 6A is an upper frontal view of two assembled panels, each one with frame and door incorporated, so they form together two centralized opening doors.
Figure 6B:
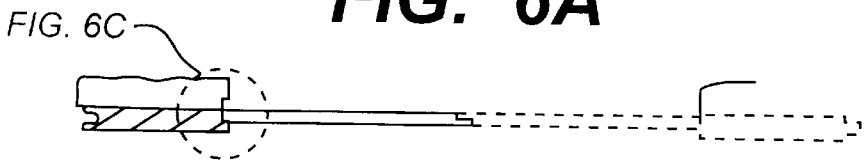
FIG. 6B is a cross-section along line 6B—6B' in FIG. 6A.
Figure 6C:
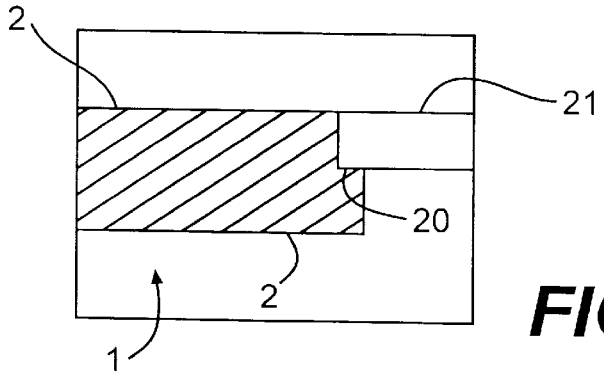
FIG. 6C is in a enlarged cross-section showing a detail of FIG. 6B.
Figure 7A:
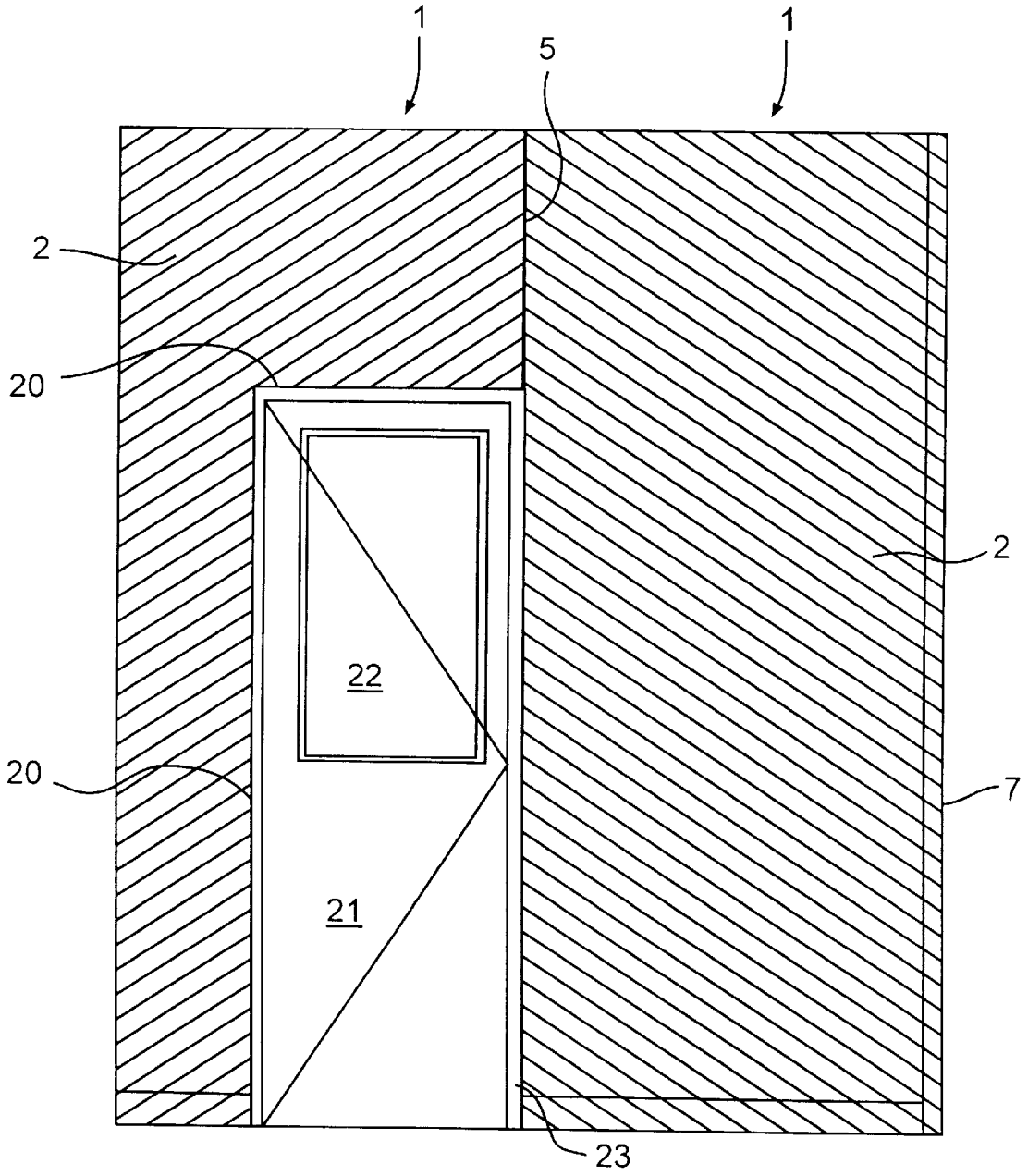
FIG. 7A is a front elevation of two assembled panels, one having a frame and door incorporated.
Figure 7B:
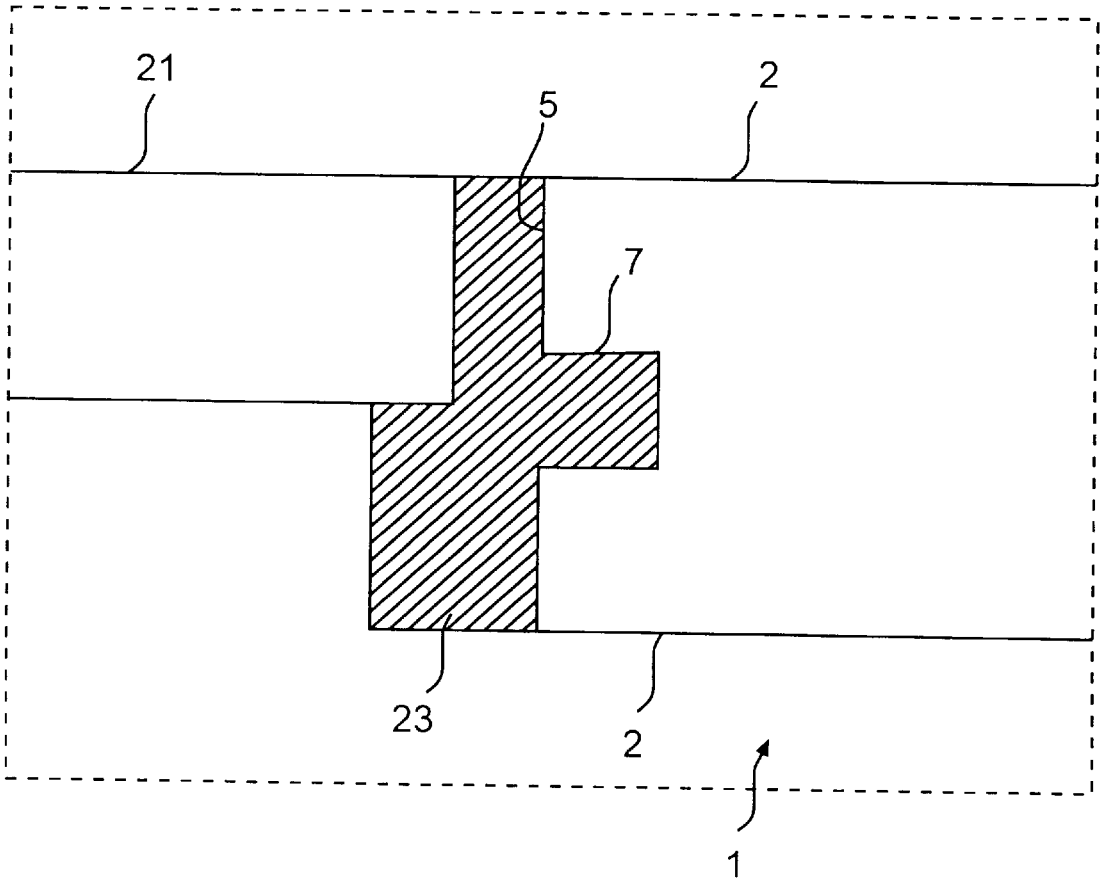
FIG. 7B is a bottom cross-section of a dovetailed frame.
Figure 8A:
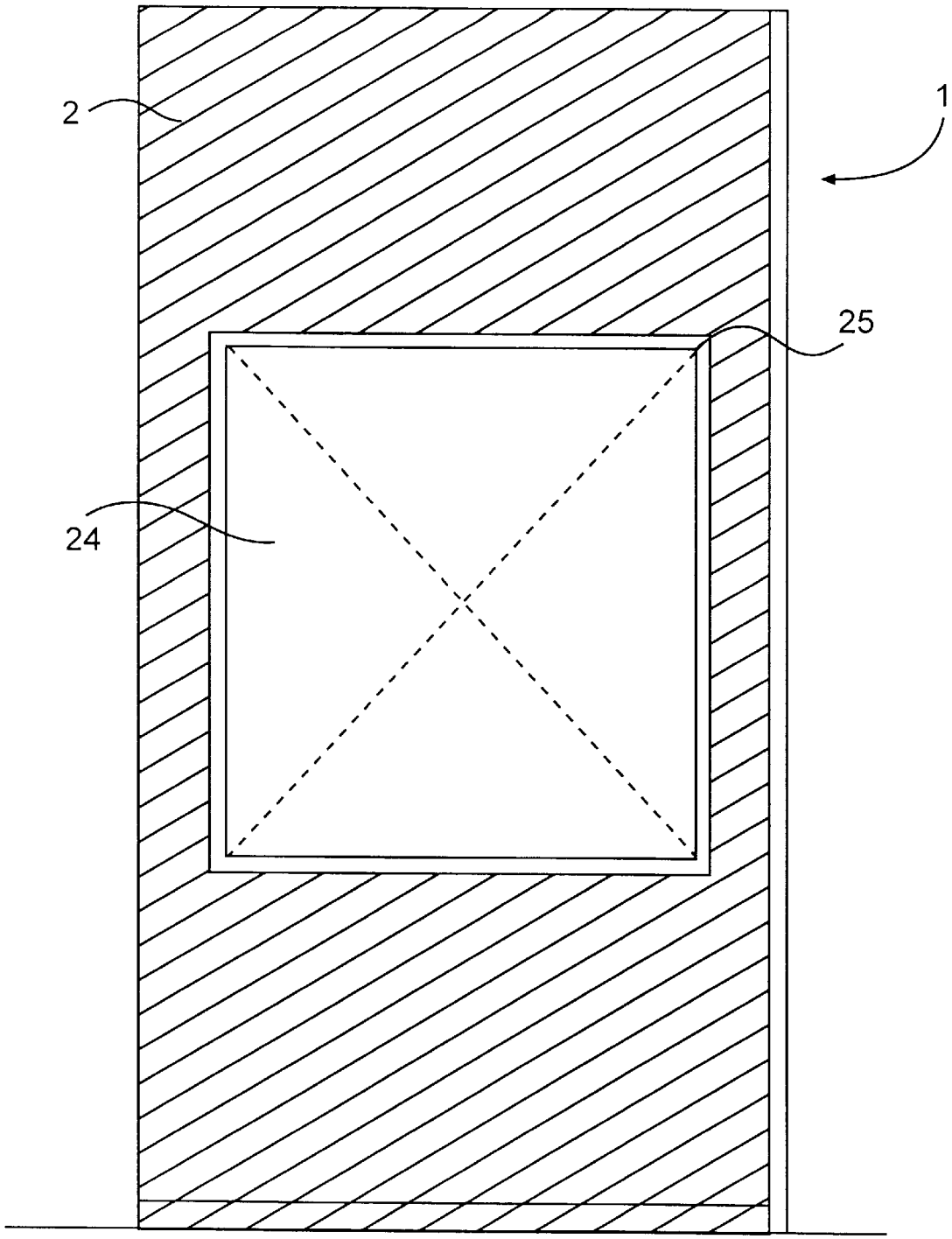
FIG. 8A is a front elevation of a panel with thermal window incorporated.
Figure 8B:
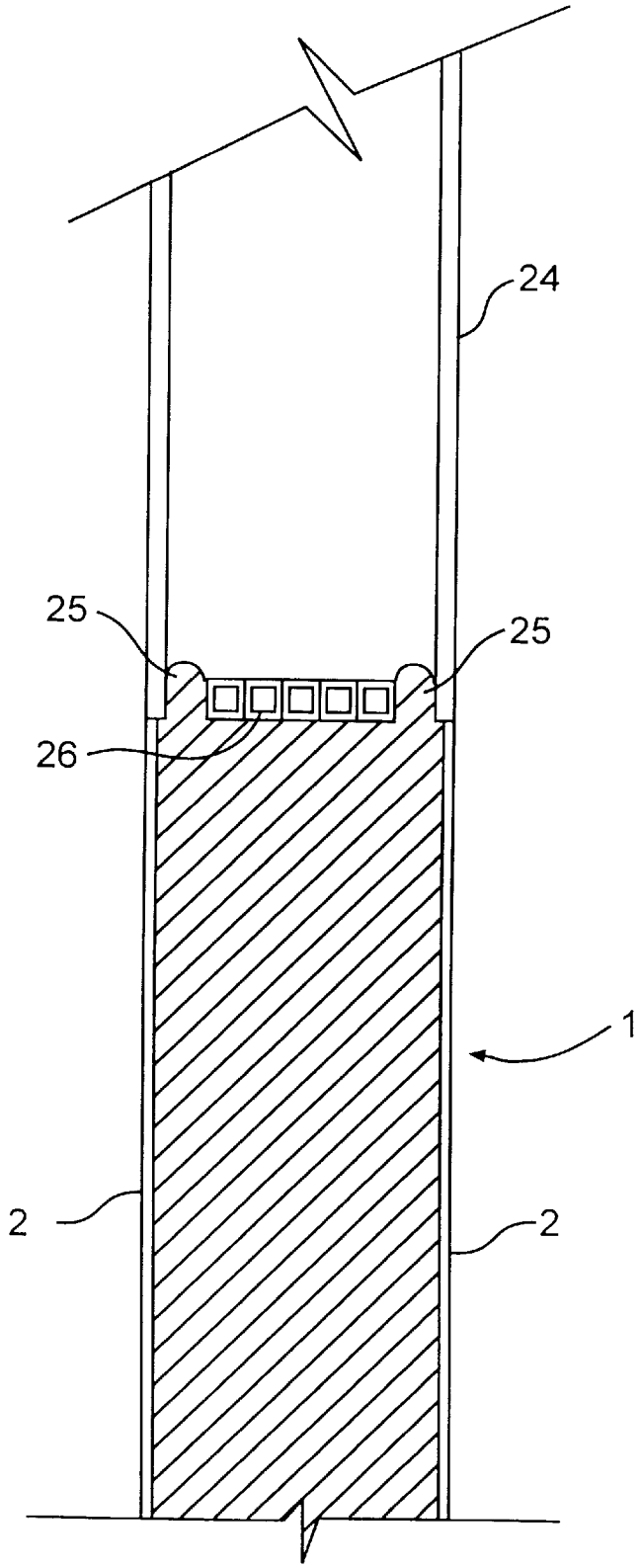
FIG. 8B is a vertical cross-section if a panel with a thermal window.
Figure 9A:
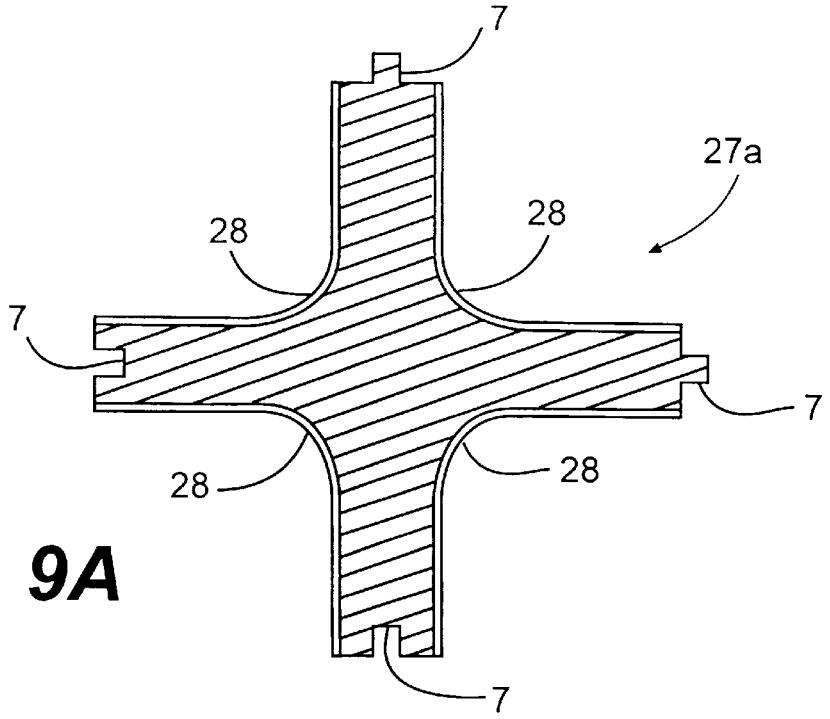
FIG. 9A is a cross-section of an "X" joint part for panels.
Figure 9B:
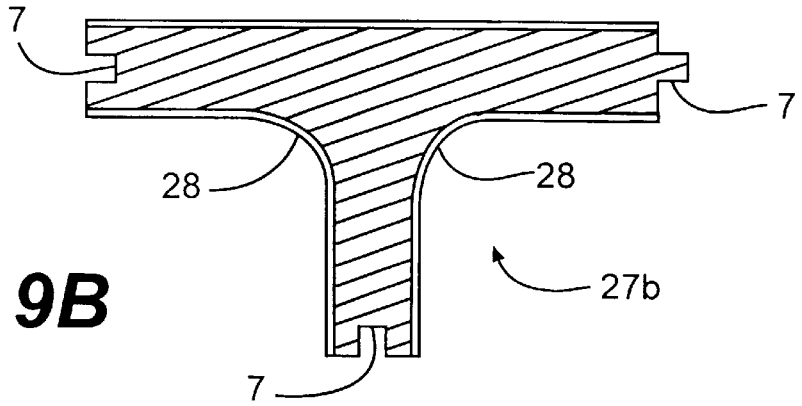
FIG. 9B is a cross-section of an "T" joint part for panels.
Figure 9C:
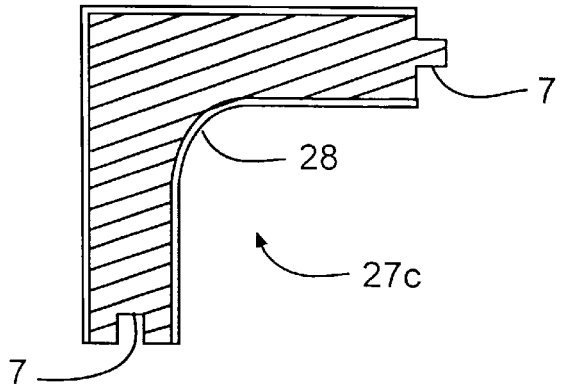
FIG. 9C is a cross-section of an "L" joint part for panels.
Figure 10:
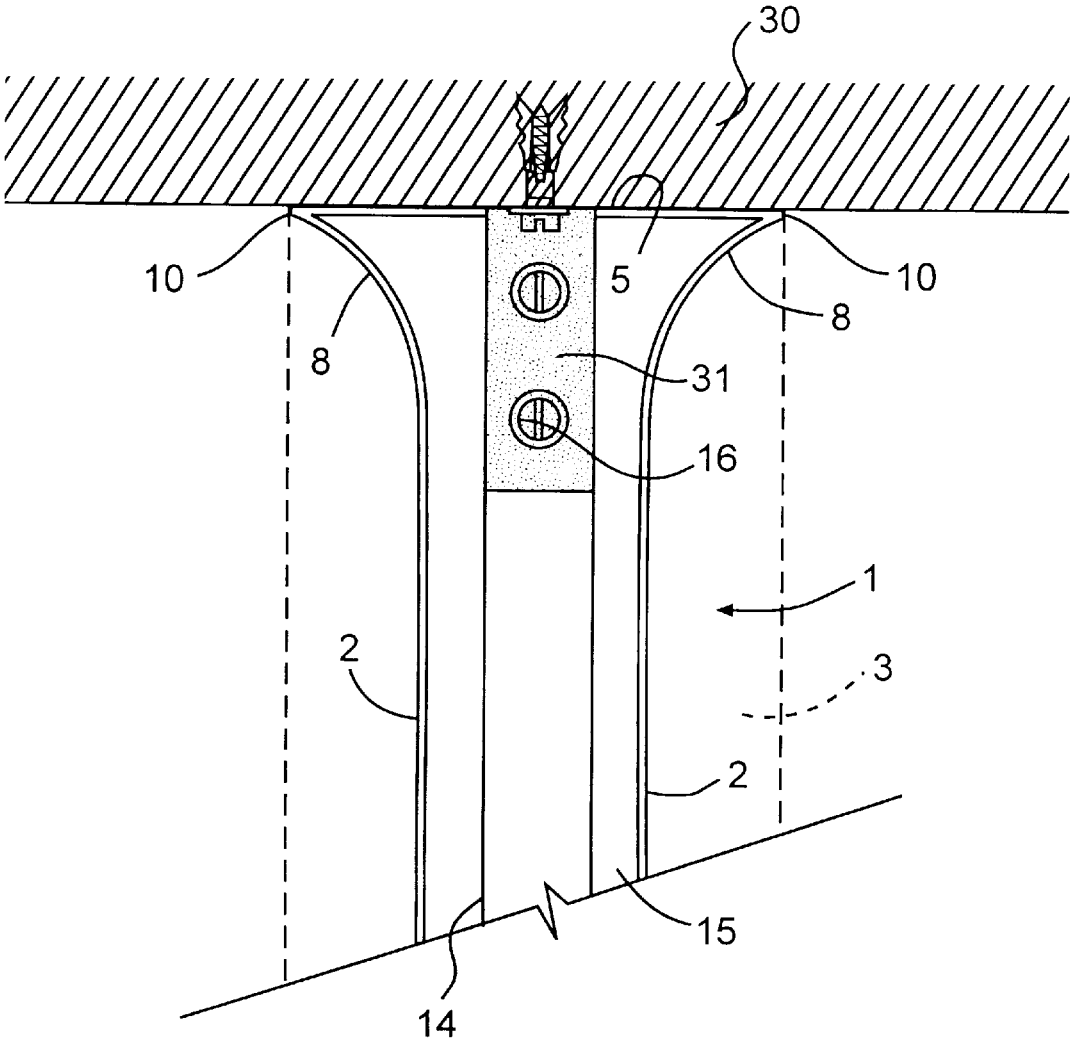
FIG. 10 is a fragmentary elevation of a corner panel fixed to an existing wall with its vertical face shown in a segmented line.

In the attached illustrations, the self-supporting panels of the invention, with sterilization, thermal and impermeability characteristics, are designated by the reference number (1).

Panels (1) of rectangular parallelepiped shape are formed by two exterior covering sheets or outer wall surfaces (2), which are parallel and their rectangular size varies according to different height and length combinations in each building. They are made of glass fiber reinforced resin and include top (3), bottom (4) and lateral (5) edge faces, thus eliminating oxidation problems and obtaining fireproof surfaces, higher resistance to chemical agents -which cause several damages due to continuous washings-, and resistant and impermeable surfaces perfectly polished and smooth, which can also be covered with plastic or painted with epoxy resins.

Between both outer wall surfaces (2) there is a core (6) filled with polyurethane and variable width, according to the thermal requirements of each building. In this way, higher panel strength and heat-isolation is possible.

Panels (1) are laterally joined by means of a dovetail joint system (7), giving an effective and quick assembly-disassembly method. The dovetail joint system (7) includes a rectangular central projection vertically extended along one panel lateral face (5). Along the other lateral face (5) of the same panel (1) there is a rectangular channel recess into which the rectangular lateral projection of another panel (1) is adjustably fitted, and this procedure is continuously repeated to join all the panels (1) in order to form a smooth continuous surface wall, according to the required sizes of every particular building. Afterwards, joints existing between panels (1) are welded, making them impermeable, hermetic and isolated.

Panels (1) have top and bottom laterally projecting edge faces (3) and (4), of increasing width and defining concave curved surfaces in top and bottom sections of each outer face (2), respectively. These are cross-sectionally curved surfaces having a quarter-circumference, and that end in a small convex reverse curvature (10), which at the same time connects to the corresponding top (3) or bottom (4) panel edge face, so that those top and bottom concave projecting edges (8) and (9) allow for a better dust and suspension particle repelling ability. Moreover, they help to remove edging borders in joints between the panel (1) and ceiling panels (11), and between the panel (1) and floor (12), making cleaning work easier, keeping hygienic conditions, increasing bottom and top surfaces to obtain a better holding, giving a better panel (1) structural resistance, avoiding wall deformation and replacing all types of socles, mouldings and additional finishings. This implies lower material cost and most importantly, impermeability and sterilization problems caused by socal filtrations and bad installations in mouldings, or due to deterioration of those elements, can be solved.

The bottom concave projecting edges (9) of each panel (1), opposed to each other, are slightly recessed and joined to vertical outer wall surfaces (2) through a small horizontal border (13), so that each bottom concave projecting edge (9) can be completely covered by the floor covering (12), which is fixed to them in that way that it is left close to the panel outer wall surfaces (2) and, at the same time, removing unwanted filtrations and drainings in the panel base caused by continuous cleaning both of the panel (1) and the floor (12), in addition to increasing building sanitary isolation.

Both top and bottom panel faces (3) and (4) have a channel recess (14) over their central longitudinal axis. It is a rectangular cross-section channel recess that reaches panel lateral faces (5) and in which it is possible to adjustably introduce top and bottom aluminum fixing tracks (15*t*) and (15*b*). Top tracks (15*t*) are as long as the panel (1) and the bottom track (15*b*) is continuous and longer. When these are introduced into the channel recess (14), they remain close to the corresponding top and bottom faces (3) and (4). Both top tracks (15*t*) and the bottom tracks (15*b*) have top and bottom fixing holes (16). Top tracks (15*t*) are fixed to the panel (1) and to the ceiling panels (11) through screws, as the bottom track (15*b*) is fixed to the panel (1) and to the floor (12). Therefore, a top track (15*t*) is fixed to two panels (1) at the same time and so on. And the bottom track (15*t*) is also fixed at the same time to different panels, building a rigid solid wall with quick assembly-disassembly characteristics.

It is possible that panels (1) have interior supporting partition walls (17), according to applied vertical loads, longitudinally extending from top (3) and bottom (4) faces with a 45° inclination, and attached to channel recesses (14) to reach interior walls top and bottom edges (8) and (9), in this way increasing panel structural strength and, therefore, obtaining both better load supporting and weight distribution to the floor (12). Alternatively, the panel bottom face (4) can be free of external glass fiber covering, so the area left between bottom face and bottom interior partition walls (17) is filled with low density foam to obtain a better floor adherence.

There is a first building possibility with the panel (1). Different general installations can be introduced, including electrical, water, oxygen, gas and compressed air installations. Specially considering electrical installations, the panel (1) has a pair of small rectangular holes (18) located in the central area of one of its outer wall surfaces (2) at a different height. In that area, two tube bottom edges (19) can be seen, closer to each other, and slightly projecting their top edges over the panel (1) top face (3) in a central space defined by two top tracks (15*t*).

There is a second building possibility. In this case, the panel (1) has a large rectangular opening starting in one of its bottom vertex. In that opening, the lateral and a top area of an incorporated frame (20) is provided, with a dropped edge to fit a door (21)- which has a window (22) with thermopanel glass close to the door (21) outer faces—near to one of its outer faces. In the lateral side of the door (21) there is a dovetail frame (23), opposed to the incorporated frame (20), so the dovetail frame (23) is as wide as the panel (1). In one side it has a dropped edge that helps to fit closely the door (21), and in the opposed side it has a central longitudinal projection which fits perfectly in another panel rectangular channel. Therefore, the dovetail system (7) itself is the mechanism that joins both panels (1) over the door (21). Alternatively, the large opening making room for the door (21) can start in another panel (1) bottom vertex, so when both panels (1) are assembled, both openings coincide laterally with each other, forming a large space with the incorporated frame (20) lateral and top parts, where two centralized opening doors (21) are located.

There is a third building possibility. The panel (1) has a large quadrangular opening located in the central part of its outer wall surfaces (2), where a window (24) with thermopanel glass is introduced close to the panel outer wall surfaces (2), which is fixed to a pair of peripheral projections (25) existing in the opening interior edge near to each panel outer wall surface (2). Between these projections (25), condensation salts (26) are introduced.

Panels (1) are combined with different intersection parts, generating resistant and impermeable surfaces, perfectly polished and smooth, and allowing panels (1) to be joined in "X" (27*a*), "T" (27*b*) and "L" (27*c*) configurations. All these intersection parts have the same elements of the dovetail joint lateral system (7) in their edges which join panels (1).

They also have concave round vertex (28) and top (8) and bottom (9) projecting concave edges. These can be seen slightly recessed and with the small horizontal edge (13), allowing different panel combinations according to the building requirements of each building, and due to the possibility to remove edging borders there can be a good hygienic continuity.

Ceiling panel (11)—with an impermeable, resistant and perfectly polished and smooth surface—has dropped straight edges (29), so when these panels (11) are joined together, a horizontal continuous surface is obtained and the panel (1) holds ceiling panels (11) in the assembly area, fixing top track (15) to ceiling panels (11) through screws exactly in the dropped straight edges(29). In this way, a correct balance in the force and load distribution can be obtained.

Both panels (1) and the recently mentioned building possibilities, including doors (21) and windows (22), windows (24), and general installation channels combining with different intersection parts (27*a*), (27*b*) and (27*c*), and with ceiling panels (11) and floor covering (12), and through fixing track systems (15), can form self-supporting structures generating heat-isolated, sterilized and impermeable spaces, according to each building lighting and watertight requirements. They also can be fitted to existing walls (30) and, in this case, there exists a fourth building possibility. This time top (8) and bottom (9) concave projecting edges extend vertically next to a panel lateral face (5), widening in that way that the surface connected to the existing wall (30) is increased, the edging border is removed and the top track (15) connected to an angled square full of fixing holes is joined to the track (15)—and the existing wall (30) through screws.

What is claimed is:

1. Self-supporting wall panels for interior spaces requiring sterilization, impermeability and thermal characteristics, each of the panels comprising a rectangular parallelepiped having two outside covering sheets to define spaced, generally parallel, flat wall surfaces, a core of cellular foam insulation, and top, bottom and lateral edge faces, the flat wall surfaces and at least the top, and lateral edge faces being formed of glass fiber reinforced resin, wherein the top and bottom edge faces are wider than the spacing of the flat wall surfaces and curved concave surfaces extend between the flat wall surfaces and the respective top and bottom edge faces, wherein both top and bottom panel edge faces have a central channel recess extending through the lateral edge faces to receive top and bottom fixing tracks, and wherein the lateral edge faces have a dovetail joint system including a rectangular central projection vertically extended along one of the lateral edge faces of each panel and a rectangular channel recess extended along the other lateral edge face of the same panel, whereby a plurality of the panels may be joined to form a smooth continuous surface wall, and resulting joints between panels, may be welded to make the joints impermeable, hermetic and isolated.

2. The self-supporting wall panels of claim 1, wherein the curved concave surfaces extend through a quarter-circumference, and end at the top and bottom edge faces in small convex reverse curvature edges.

3. The self-supporting panels of either of claims 1 or 2, wherein concave curved surfaces ending at the bottom edge face are opposed to each other, slightly recessed and connected to the flat wall surfaces through a small horizontal border, so that each concave arch ending at the bottom edge face can be completely covered by a floor covering.

4. The self-supporting panels of claim 1, including a top track as long as each panel, and a continuous longer bottom track, the top and bottom tracks, when introduced into the recess channels, remain close to the corresponding top and bottom panel faces, wherein both top and bottom tracks have top and bottom fixing holes for screws to fix the top tracks to the panel and to ceiling panels and to fix the bottom track to the panel and to a floor.

5. The self-supporting panels of either of claims 1, 2, or 4, including interior supporting partition walls extending longitudinally between top and bottom edge faces and the recess channels, with a 45° inclination, for increasing panel structural strength for higher loads and for distributing weight to a floor.

6. The self-supporting panels of any one of claims 1, 2, or 4, including electrical, water, oxygen, gas and compressed air installations, at least one of the panels having, for electrical installations, a pair of small rectangular holes located in the central area of one of the flat wall surfaces and, at a different height, two tube bottom edges close to each other, and slightly projecting at the tube top edges above the panel top edge face level in a space between two top tracks.

7. The self-supporting panels of any one of claims 1, 2, or 4, wherein the panel has a large rectangular opening starting in the bottom edge face and having a lateral and top edge portions of an incorporated frame with a recessed edge to receive a door, a lateral edge portion of the door having a dovetail frame, opposed to the incorporated frame, and as wide as the panel.

8. The self-supporting panels of any one of claims 1, 2, or 4, wherein at least one of the panels has a large quadrangular opening in a central part of the flat wall surfaces to receive a window with glass substantially flush with the flat wall surfaces of the panel, the window being fixed to a pair of peripheral projections in the interior edge of the large quadrangular opening.

9. The self-supporting panels of any one of claims 1, 2, or 4, wherein concave projecting edges extend vertically next to a panel lateral face, thereby widening the lateral side edge face to be connected to an existing wall.

10. The self-supporting panels of any one of claims 1, 2, or 4, wherein a combination of different intersection parts are provided for joining panels in "X", "T" and "L" configurations, the intersection parts having a joint system for joining with the lateral side edges of each panel, and round concave surface portions to merge with the flat wall surfaces of the panels.

11. The self-supporting panels of any one of claims 1, 2, or 4, including ceiling panels with an impermeable, polished and smooth surface and having dropped straight edges, so when the ceiling panels are joined together, a continuous horizontal surface is formed, the ceiling panels being fixed to the wall panels by the top fixing track by screws.

* * * * *